US009597907B2

(12) United States Patent
Kohyama

(10) Patent No.: US 9,597,907 B2
(45) Date of Patent: Mar. 21, 2017

(54) PRINTER

(71) Applicants: CITIZEN HOLDINGS CO., LTD., Nishitokyo-shi, Tokyo (JP); CITIZEN SYSTEMS JAPAN CO., LTD., Nishitokyo-shi, Tokyo (JP)

(72) Inventor: Takuro Kohyama, Nishitokyo (JP)

(73) Assignees: Citizen Watch Co., LTD., Nishitokyo-Shi, Tokyo (JP); Citizen Systems Japan Co., LTD., Nishitokyo-Shi, Tokyo (JP)

( * ) Notice: Subject to any disclaimer, the term of this patent is extended or adjusted under 35 U.S.C. 154(b) by 0 days.

(21) Appl. No.: 15/144,253

(22) Filed: May 2, 2016

(65) Prior Publication Data

US 2016/0243865 A1 Aug. 25, 2016

Related U.S. Application Data

(63) Continuation of application No. PCT/JP2014/084191, filed on Dec. 24, 2014.

(30) Foreign Application Priority Data

Mar. 31, 2014 (JP) ..... 2014-071554

(51) Int. Cl.
*B41J 29/02* (2006.01)
*B41J 15/04* (2006.01)

(52) U.S. Cl.
CPC ..... *B41J 29/02* (2013.01); *B41J 15/04* (2013.01); *B41J 15/042* (2013.01)

(58) Field of Classification Search
CPC . B41J 29/00; B41J 29/026; B41J 29/02; B41J 29/023
See application file for complete search history.

(56) References Cited

U.S. PATENT DOCUMENTS 8,277,040 B2 * 10/2012 Ishida ..... B41J 29/02 271/197
8,297,864 B2 * 10/2012 Tsugaru ..... B41J 29/02 400/621

(Continued)

FOREIGN PATENT DOCUMENTS

JP 2000-16652 A 1/2000
JP 2001-341856 A 12/2001

(Continued)

OTHER PUBLICATIONS

International Search Report issued for corresponding International Patent Application No. PCT/JP2014/084191 mnailed on Mar. 24, 2015 with an English translation.

*Primary Examiner* — Kristal Feggins
(74) *Attorney, Agent, or Firm* — Myers Wolin, LLC

(57) ABSTRACT

In a printer having a housing forming a substantially box shape; a pair of frames disposed in the housing and arranged such that the frames oppose each other across a conveyance path of a recording medium; a cutout portion disposed at an upper end of each of the frames; and a shaft that while inserted inside a winding core on which long paper is wound into a roll shape, both ends of the shaft are supported by the cutout portions and the shaft holds the paper while allowing the paper to be pulled out from the housing; an exterior cover is disposed in the housing. The exterior cover is formed using an insulating material, has openings that open the cutout portions exteriorly, and covers the pair of the frames with the cutout portions opened exteriorly through the openings.

2 Claims, 12 Drawing Sheets

(56) References Cited

U.S. PATENT DOCUMENTS

| | | | | |
|---|---|---|---|---|
| 8,585,305 | B2 * | 11/2013 | Naito | B41J 29/02 347/222 |
| 2014/0085395 | A1 * | 3/2014 | Takahashi | B41J 29/00 347/222 |

FOREIGN PATENT DOCUMENTS

| | | | |
|---|---|---|---|
| JP | 2002-296861 | A | 10/2002 |
| JP | 2006-312321 | A | 11/2006 |
| JP | 2008-239259 | A | 10/2008 |
| JP | 2008-284842 | A | 11/2008 |
| JP | 2009-169126 | A | 7/2009 |

* cited by examiner

PRINTER

CROSS-REFERENCE TO RELATED APPLICATIONS

This is a continuation under 35 U.S.C. 120 of International Application No. PCT/JP2014/084191 filed on Dec. 24, 2014, which claims priority to Japanese Patent Application No. JP2014-071554 filed on Mar. 31, 2014, the contents of each which is incorporated by reference herein.

TECHNICAL FIELD

The present invention relates to a printer using large-sized heavy roll paper as a recording object.

BACKGROUND ART

A conventional printer performs a recording operation on a long paper sheet wound into a roll shape (roll paper). When such a printer uses a recording object that is roll paper large in size and heavy consequent to having a large diameter and width in the rolled state, a frame that holds the roll paper is formed of a metal plate-shaped member having a certain thickness so as to ensure the strength of the mechanism holding the roll paper.

Printers include electrical system components for drive control and power supply to units included in the printer and these electrical system components must be insulated. In the case of a configuration using a metal frame for holding roll paper, the frame must be insulated. Conventionally, for example, arrangement is such that insulation properties of the frame are ensured by coating the metal frame with a paint having high electrical insulation properties.

Techniques related to a printer using roll paper as a recording object include, for example, a technique of a label printer that is configured to rotatably support a core shaft for mounting a label sheet and has a body core unit that is a cylindrical shape having a first diameter and insertable into a winding core portion of a label sheet and a label sheet mounting unit disposed at a predetermined part in a longitudinal middle portion of the body core unit and having a second diameter that is smaller than the first diameter (see, e.g., Patent Documents 1 and 2).

Patent Document 1: Japanese Laid-open Patent Publication No. 2008-239259

Patent Document 2: Japanese Laid-open Patent Publication No. 2008-284842

DISCLOSURE OF INVENTION

Problem to be Solved by the Invention

Nonetheless, the conventional techniques described above have the problem of a complicated configuration for insulating electrical system components disposed at multiple positions in the printer. The conventional techniques also have a problem in that the complicated configuration of the printer leads to increased manufacturing man-hours, a large worker burden required for manufacturing, and high manufacturing costs. For example, since the electrical system components are attached in an insulated state and a metal frame coated with a paint having high electrical insulation properties is separately disposed, the conventional techniques have the problems of increased manufacturing man-hours, a large worker burden required for manufacturing, and high manufacturing costs.

Additionally in the conventional techniques described above, to ensure the insulation properties of the frame, the frame is coated with a paint having high insulation properties, which leads to problems of increased manufacturing man-hours, a large worker burden required for manufacturing, and high manufacturing costs.

To solve the problems associated with the conventional techniques above, one object of the present invention is to reduce the manufacturing cost of a printer having ensured strength for holding large-diameter roll paper.

Means for Solving Problem

To solve the problems above and achieve an object, a printer according to the present invention includes a housing forming a substantially box shape; a pair of frames disposed in the housing and arranged such that the frames oppose each other across a conveyance path of a recording medium; a cutout portion disposed at an upper end of each of the frames; a shaft that while inserted inside a winding core on which long paper is wound into a roll shape, both ends of the shaft are supported by the cutout portions and the shaft holds the paper while allowing the paper to be pulled out from the housing; and an exterior cover that is disposed in the housing, is formed using an insulating material, has openings that open the cutout portions exteriorly, and covers the pair of the frames with the cutout portions opened exteriorly through the openings.

The printer according to the invention further includes electrical system components disposed in the housing and related to driving of units included in the printer, where the exterior cover also covers the electrical system components.

Effect of the Invention

The printer according to the present invention achieves an effect of enabling a reduction in manufacturing costs of a printer having ensured strength for holding large-diameter roll paper.

BEST MODE(S) FOR CARRYING OUT THE INVENTION

A preferred embodiment of a printer according to the present invention will be described in detail with reference to the accompanying drawings.

Figure 1:
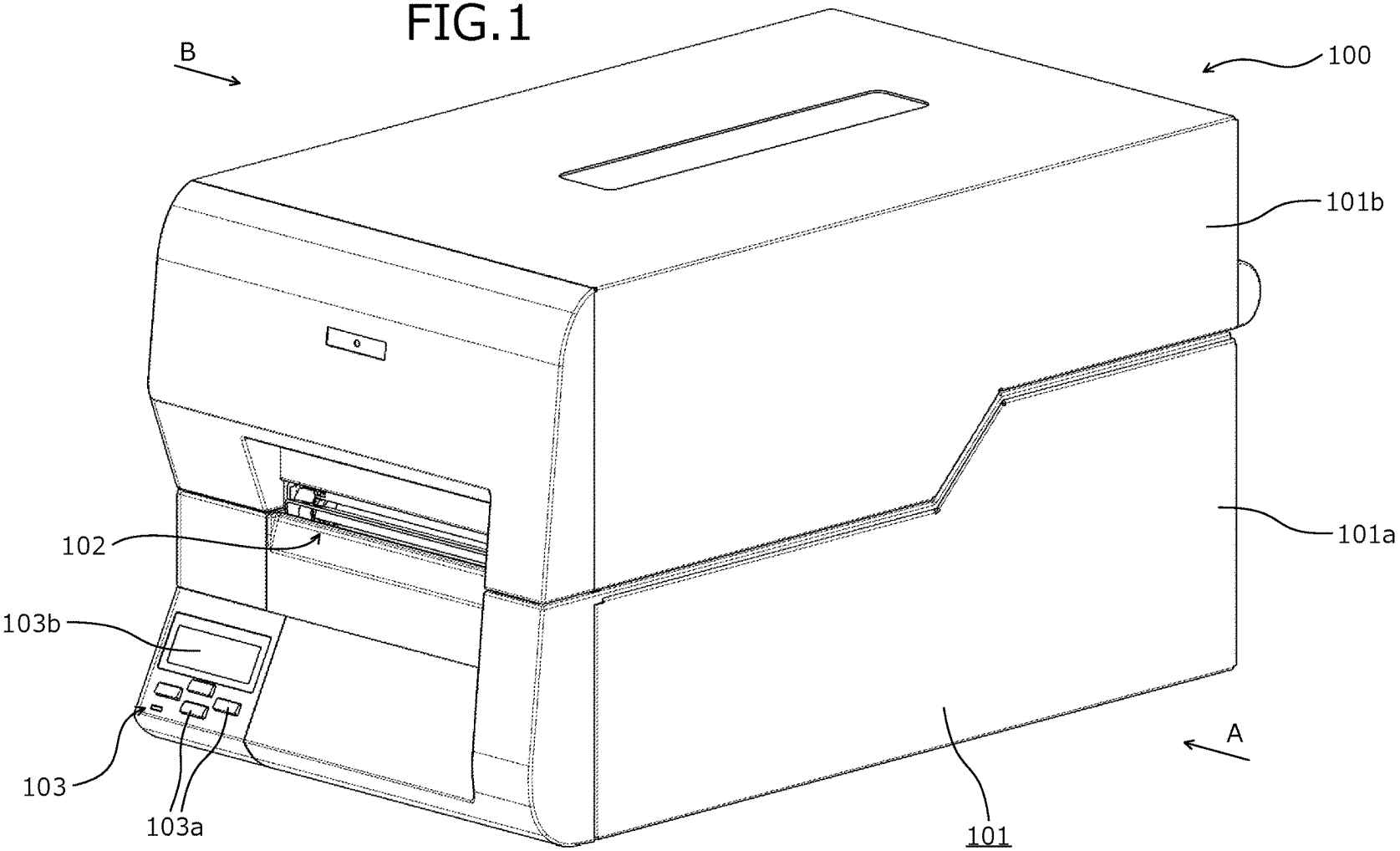
FIG. 1 is an explanatory view of the exterior of a printer of an embodiment according to the present invention.

A configuration of a printer of an embodiment according to the present invention will be described. FIG. 1 is an explanatory view of an exterior of the printer of the embodiment according to the present invention. FIG. 1 depicts the printer of the embodiment according to the present invention in an installed state, viewed obliquely from above.

In FIG. 1, a printer 100 of the embodiment according to the present invention includes a housing 101 forming a hollow parallelepiped shape. The housing 101 includes a lower housing 101*a* having an opening in an upper aspect and forming a substantially box shape, and an upper housing 101*b* closing the opening of the lower housing 101*a* in an openable manner.

The upper housing 101*b* has an opening in a lower aspect and closes the opening of the lower housing 101*a* with the opening of the upper housing opposing the opening of the lower housing 101*a*. The upper housing 101*b* is supported about an axis by the lower housing 101*a*, at a rear aspect of the printer 100 (on the right side of FIG. 1) and is thereby rotatably coupled to the lower housing 101*a*.

With the opening of the lower housing 101*a* closed by the upper housing 101*b*, the housing 101 forms a housing space that houses a printer main body (see FIGS. 4 and 5) inside the upper housing 101*b* and the lower housing 101*a*. With the opening of the lower housing 101*a* closed by the upper housing 101*b*, the housing 101 forms a discharge port 102 that discharges a recorded recording medium in a front surface (on the left side of FIG. 1) of the housing 101. The discharge port 102 is formed in a boundary portion between the upper housing 101*b* and the lower housing 101*a*.

On an outer surface of the housing 101, the front surface of the housing 101 (the lower housing 101*a*) is equipped with an operation panel 103. The operation panel 103 includes buttons 103*a* that receive various input operations and a display panel 103*b* that displays a state, etc. of the printer 100.

The display panel 103*b* displays a given message to report the state of the printer 100 such as when the printer is powered on and put into a print stand-by state, an error occurs in the printer 100, or the remaining amount of paper held by the printer 100 becomes less than or equal to a predetermined amount. The display panel 103*b* can be realized by a liquid crystal display, for example.

Figure 2:
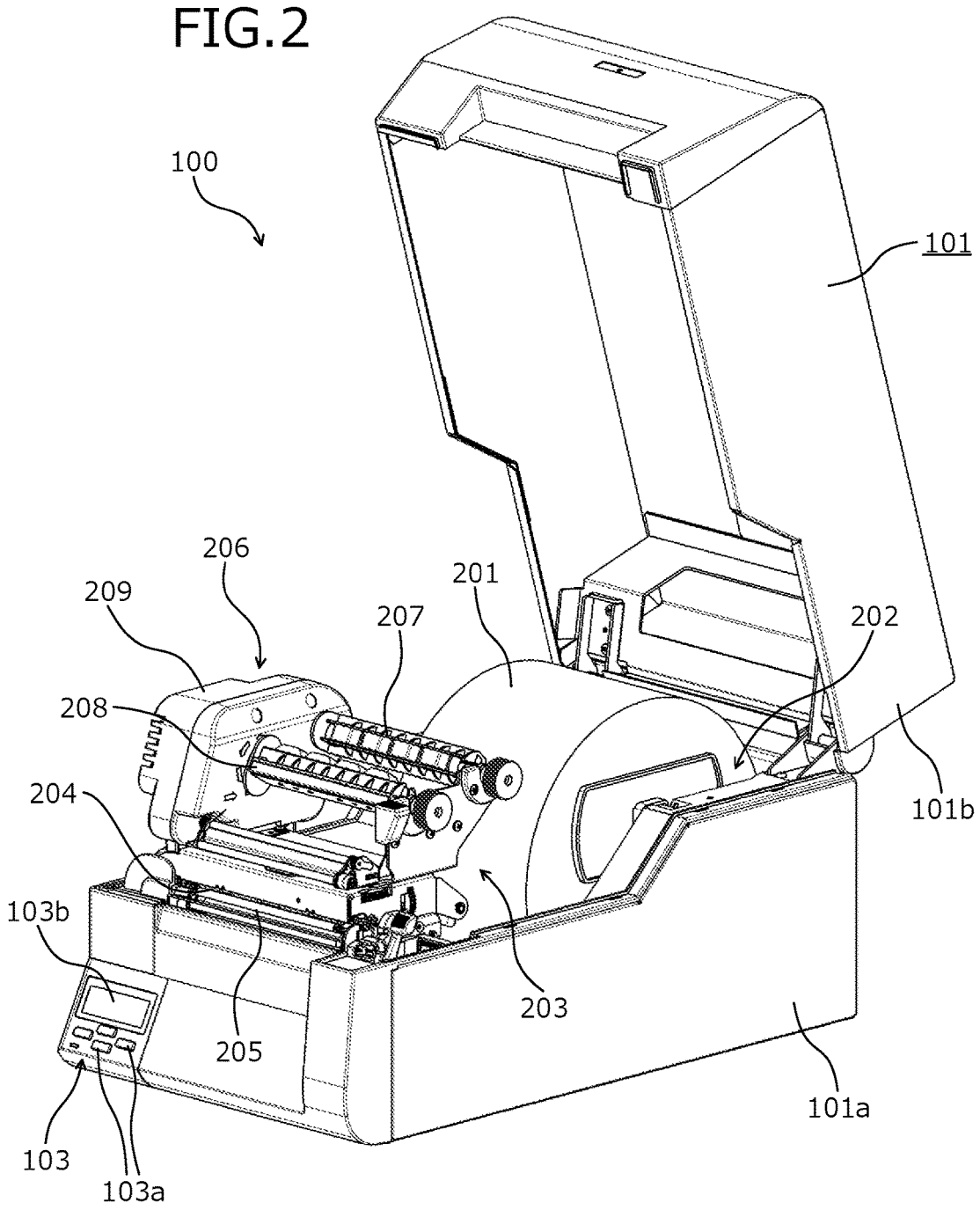
FIG. 2 is an explanatory view (part 1) of the printer with a housing opened.
Figure 3:
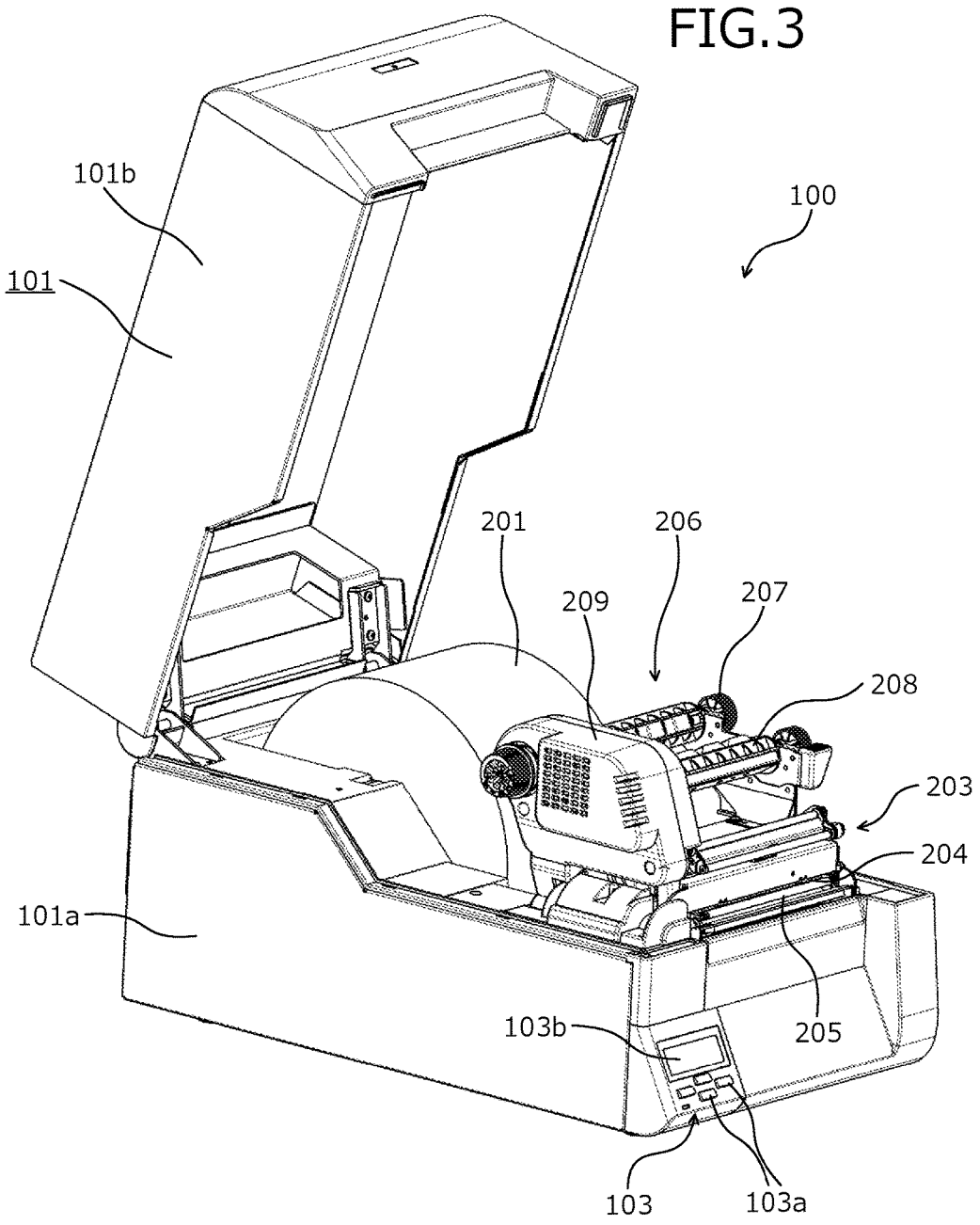
FIG. 3 is an explanatory view (part 2) of the printer with the housing opened.

FIGS. 2 and 3 are explanatory views of the printer 100 with the housing 101 opened. FIG. 2 depicts the printer 100 with the inside of the housing 101 opened exteriorly, as viewed from a position located on the upper right side with respect to the front surface of the printer 100. FIG. 3 depicts the printer 100 as viewed from a position located on the upper left side with respect to the front surface of the printer 100.

In FIGS. 2 and 3, the printer 100 includes a paper holding unit 202 that, at a rear aspect in the housing 110, holds a recording medium (paper) 201 that is used as a recording object and wound into a roll shape. The recording medium (paper) 201 used as a recording object may be continuous forms wound into a roll shape or may be a label sheet with multiple labels arranged along a longitudinal direction of a mount.

The printer 100 includes a head unit 203 disposed closer to the front surface as compared to the paper holding unit 202 in the housing 101. A conveyance path is formed inside the housing 101 from the paper holding unit 202 via the head unit 203 to the discharge port 102. At the time of a recording operation in the printer 100, the paper 201 wound into a roll shape held by the paper holding unit 202 is pulled out from a longitudinal end portion on the outer circumference and conveyed via the head unit 203 to the discharge port 102.

The head unit 203 includes a print head 204. The print head 204 performs a thermal type recording operation, for example. The print head 204 that performs a thermal type recording operation includes multiple heating elements arranged in a line along a width direction of the printer 100 (along a direction orthogonal to the conveyance direction of the paper 201).

The printer 100 selectively energizes the heating elements in the thermal head to selectively cause the heating elements to generate heat and thereby performs the recording operation. The head unit 203 may include the print head 204 of another type of recording instead of the thermal type recording.

In the housing 101, a platen 205 is disposed facing the print head 204 across the conveyance path (the paper 201 being conveyed through the conveyance path). The platen 205 forms a substantially columnar shape having an axial direction that is along the width direction of the printer 100. At the time of the recording operation, the platen 205 supports a rear surface of the paper 201 while a pushing force is applied to a front surface (a recording surface) by the print head 204. The print head 204 is biased in a direction toward the platen 205.

To one end of an axis of the platen 205, a motor (see reference numeral 507 of FIG. 5) is attached via a gear train not depicted. The gear train rotates by transmitting a drive force of the motor. The platen 205 rotates accompanying the rotation of gears making up the gear train. The platen 205 rotates and thereby, conveys the paper 201 in the conveyance path, from the paper holding unit 202 side toward the discharge port 102.

The head unit 203 includes a ribbon unit 206 supporting an ink ribbon not depicted. The ribbon unit 206 includes a ribbon support shaft 207 supporting the ink ribbon before the ink ribbon is provided for a recording operation and a ribbon winding shaft 208 winding the ink ribbon after a recording operation. The ribbon unit 206 also includes a ribbon shaft drive mechanism that rotates the ribbon winding shaft 208 to feed the ink ribbon supported by the ribbon support shaft 207 and wind the fed ink ribbon around the ribbon winding shaft 208. The ribbon shaft drive mechanism is housed in a case 209 and is made up of a motor (see reference numeral 405 of FIG. 5), a wheel train that transmits the drive force of the motor to the ribbon winding shaft 208, a ribbon board that drives the motor, etc.

Figure 4:
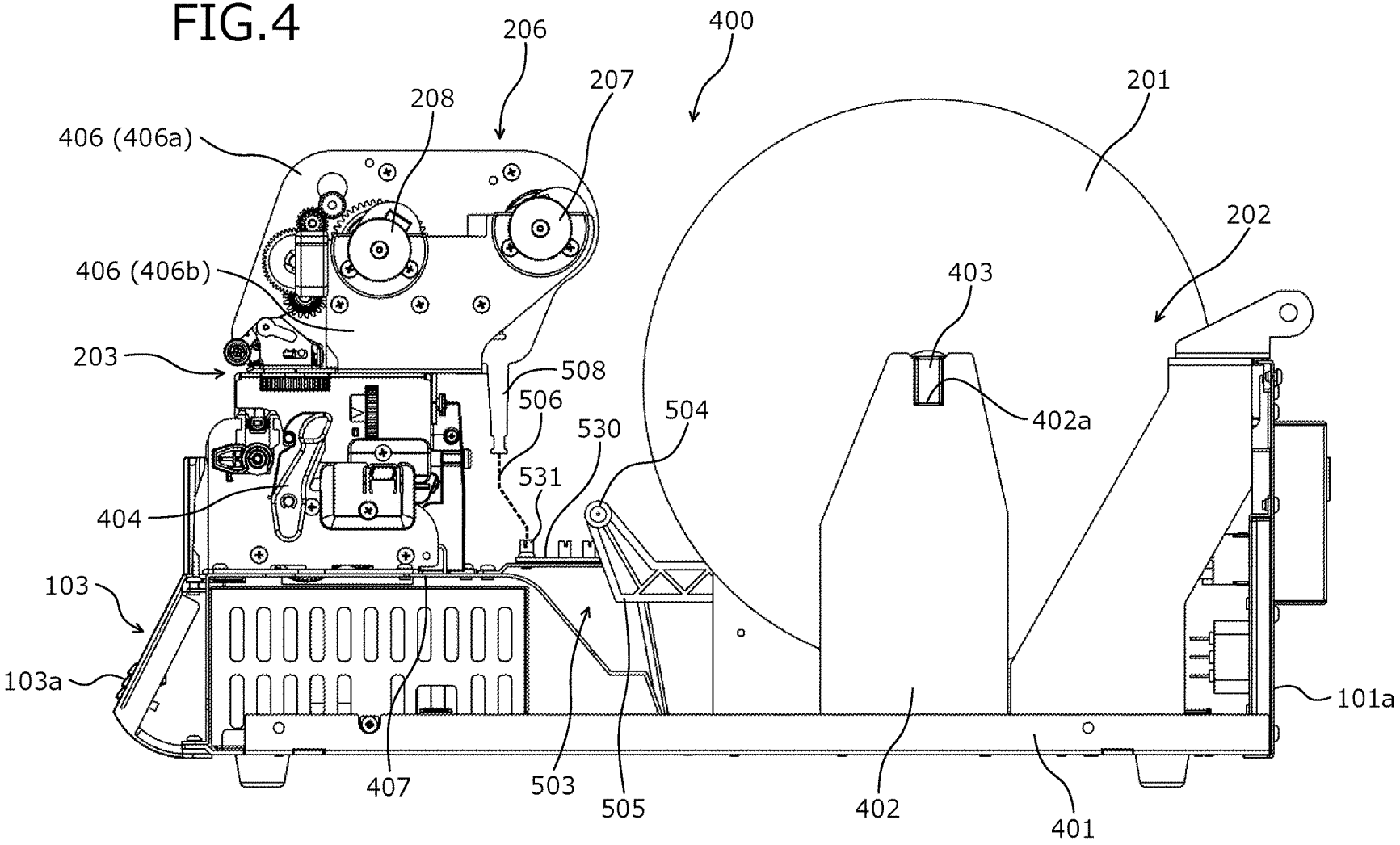
FIG. 4 is a side view (part 1) of a head unit and a printer main body.
Figure 5:
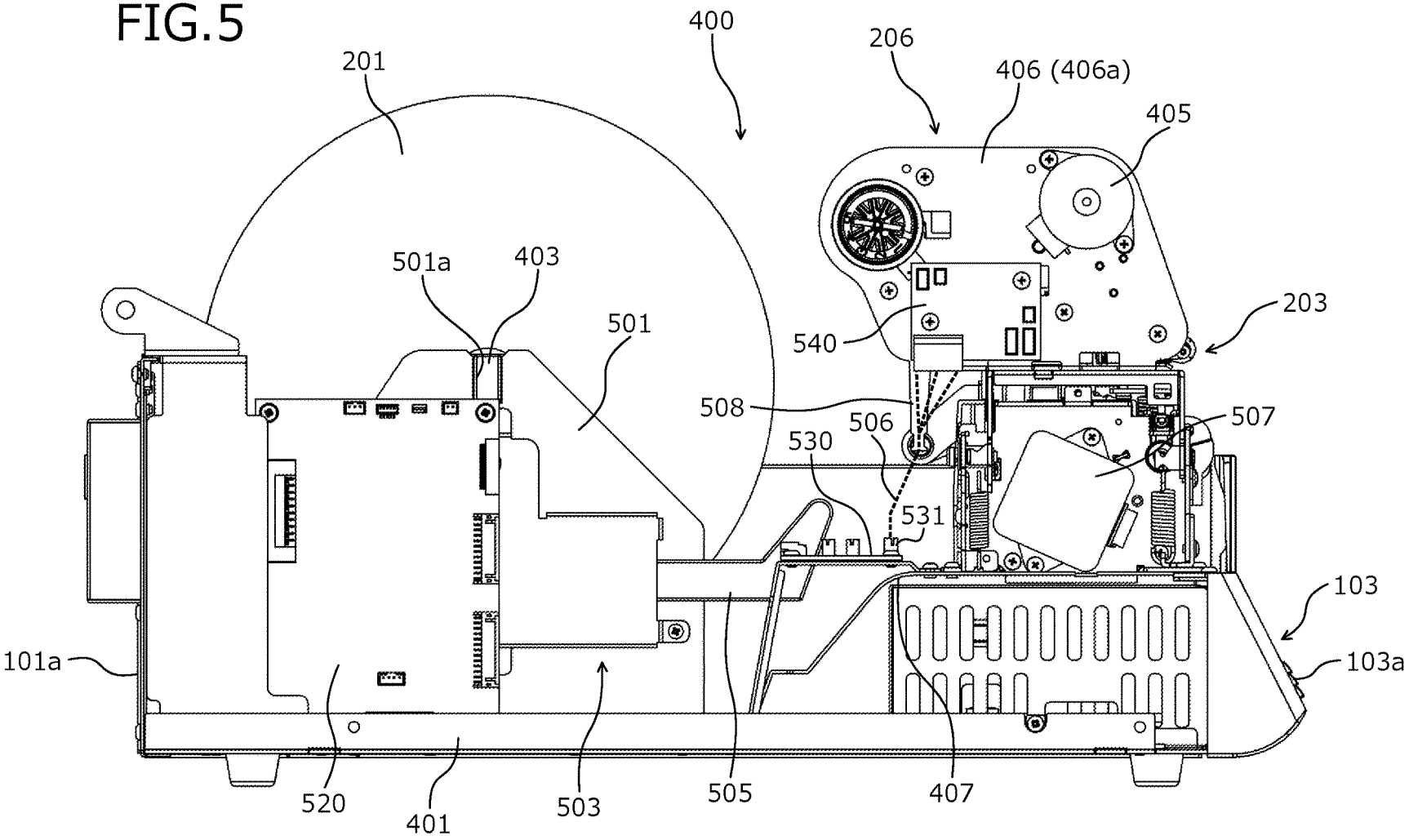
FIG. 5 is a side view (part 2) of the head unit and the printer main body.

FIGS. 4 and 5 are side views of the head unit 203 and the printer main body. FIG. 4 depicts the printer main body with the housing 101 removed as viewed in the direction indicated by arrow A in FIG. 1. FIG. 5 depicts the printer main body with the housing 101 removed viewed in the direction indicated by arrow B in FIG. 1. FIGS. 4 and 5 depict a state in which the case 209 is removed in the ribbon unit 206.

In FIGS. 4 and 5, the printer main body 400 includes a bottom frame 401 disposed in the housing 101. The bottom frame 401 is formed by sheet-metal working of a metal plate-shaped member having a predetermined thickness. A pair of shaft paper guides 402, 501 realizing a pair of frames is disposed in the bottom frame 401.

The pair of the shaft paper guides 402, 501 is disposed at the position of the paper holding unit 202 in the housing 101. The pair of the shaft paper guides 402, 501 is disposed such that the shaft paper guides 402, 501 oppose each other along the width direction of the printer 100. When the paper holding unit 202 holds the paper 201 that is wound into a roll shape, the pair of the shaft paper guides 402, 501 is disposed such that the shaft paper guides 402, 501 oppose each other across the paper 201, which is wound into a roll shape.

Cutout portions 402*a*, 501*a* are disposed respectively in upper ends of the pair of the shaft paper guides 402, 501. The cutout portions 402*a*, 501*a* form a rectangular shape opened on the upper side (a portion on the upper side in FIGS. 4 and 5). The cutout portions 402*a*, 501*a* support a shaft 403 that holds the paper 201 that is wound into a roll shape and housed in the paper holding unit 202, the paper 201 being held such that the paper 201 can be pulled out from the paper holding unit 202.

The shaft 403 can be realized by a rod-like member having a cross section forming a polygonal shape (e.g., a quadrangular shape). The shaft 403 is formed by using an insulating material such as a plastic material, for example. The cutout portions 402*a*, 501*a* are formed by partially cutting out the upper end portions of the pair of the shaft paper guides 402, 501 in a size and shape substantially identical to the outer shape of the cross section of the shaft 403.

The ends of the shaft 403 are respectively fitted into the cutout portions 402*a*, 501*a* disposed respectively in the pair of the shaft paper guides 402, 501, whereby the shaft 403 is supported by the pair of the shaft paper guides 402, 501. The shaft 403 is attached to the paper holding unit 202 in a detachable manner. The shaft 403 is removed from the paper holding unit 202 such as when the paper 201 is replaced.

The paper holding unit 202 supports the shaft 403 with the pair of the shaft paper guides 402, 501, the shaft 403 being inserted inside a winding core of the paper 201 wound into a roll shape. Thereby, the paper holding unit 202 holds the paper 201, which is long and wound into a roll shape, such that the paper 201 can be pulled out from the longitudinal end portion on the outer circumference. The shaft 403 is inserted inside the winding core without being fixed to the winding core and therefore, supports the winding core of the paper 201, enabling rotation around the shaft 403. Thus, rotation of the winding core of the paper 201 around the shaft 403 enables the paper 201 housed in the paper holding unit 202 to be pulled out from the longitudinal end portion on the outer circumference.

The shaft paper guides 402, 501 are respectively formed by sheet-metal working of a metal plate-shaped member having a predetermined thickness. Forming the shaft paper guides 402, 501 respectively from a metal plate-shaped member having a predetermined thickness enables the both ends of the shaft 403 inserted inside the winding core of the paper 201 to be safely and assuredly supported even when the paper 201 wound into a roll shape is roll paper having a large diameter and large weight.

The shaft paper guide 501 of the pair of the shaft paper guides 402, 501 is equipped with a damper mechanism 503. The damper mechanism 503 includes a damper shaft 504 swingable in contacting and separating directions with respect to the paper 201 in the conveyance path. The damper shaft 504 is positioned between the paper holding unit 202 and the head unit 203 in the conveyance path.

The damper shaft 504 forms a rod shape having a circular cross section and an axial direction that is the width direction of the printer 100. One end of the damper shaft 504 is attached to a tip of a damper arm 505. The damper arm 505 is disposed rotatably in a plane formed by the shaft paper guide 501, by using one end coupled to the shaft paper guide 501 as a fulcrum. The damper arm 505 rotates by using the one end as a fulcrum, thereby swinging the damper shaft 504 disposed at the other end in the contacting and separating directions with respect to the paper 201 in the conveyance path.

The damper mechanism 503 includes a biasing member (not depicted) biasing the damper arm 505 in a direction of bringing the damper shaft 504 into contact with the paper 201. The biasing member can be realized by a first spring and a second spring (both not shown), for example.

The first spring can be realized by a compression coil spring that compresses the damper shaft 504 from the upper side to the lower side in FIG. 5. When the damper arm 505 rotates from the lower side to the upper side, the first spring biases the damper arm 505 from the upper side to the lower side.

The second spring can be realized by a compression coil spring that compresses the damper shaft 504 from the lower side to the upper side in FIG. 5. When the damper arm 505 rotates from the upper side to the lower side, the second spring biases the damper arm 505 from the lower side to the upper side.

When the paper 201 held by the paper holding unit 202 is so-called outward roll paper having a recording surface that is a surface on the outer circumferential side when the paper is wound into a roll shape, the paper 201 is guided through the conveyance path such that the damper shaft 504 is brought into contact with the paper 201 from the lower side in FIGS. 4 and 5. When the paper 201 held by the paper holding unit 202 is so-called inward roll paper having a recording surface that is a surface on the inner circumferential side when the paper is wound into a roll shape, the paper 201 is guided through the conveyance path such that the damper shaft 504 is brought into contact with the paper 201 from the upper side in FIGS. 4 and 5. The paper 201 is guided through the conveyance path to come into contact with the damper shaft 504 between the paper holding unit 202 and the head unit 203 and to be bent at the position of the contact.

When a recording operation is started and a conveyance force of the platen 205 is applied to the paper 201 in a state in which no recording operation is performed, the paper 201 is pulled in a stretched manner between the platen 205 and the paper holding unit 202 by an inertia force due to the weight of the paper 201 wound into a roll shape in the paper holding unit 202. In particular, since the conveyance force of the platen 205 is applied to the paper 201 while the inertia force tending to maintain a stopped state is acting due to the weight of the paper 201 wound into a roll shape in the paper holding unit 202, a conveyance force toward the discharge port 102 is momentarily applied to the paper 201 on the side closer to the platen 205 even though the paper 201 is stopped on the side of the paper holding unit 202. As a result, the paper 201 is pulled in a linearly stretched manner between the platen 205 and the paper holding unit 202.

Since the damper mechanism 503 includes the biasing member that biases the damper arm 505 in the direction of bringing the damper shaft 504 into contact with the paper 201, when the paper 201 is pulled in a linearly stretched manner, the damper mechanism 503 causes the damper shaft 504 to resiliently contact the paper 201 and bias the paper 201 in a bending direction. As a result, since the stretching of the paper 201 can be buffered to alleviate impact (inertia force) on the paper 201, the paper 201 can be conveyed with precision and a constant feed rate of the paper 201 can be achieved regardless of whether the paper 201 is outward roll paper or inward roll paper.

The ribbon unit 206 includes a pair of ribbon frames 406 (406*a*, 406*b*) supporting the ribbon support shaft 207 and the ribbon winding shaft 208. The ribbon frames 406 (406*a*, 406*b*) support the ribbon support shaft 207 and the ribbon winding shaft 208 at both axial end positions of the ribbon support shaft 207 and the ribbon winding shaft 208 such that the ribbon support shaft 207 and the ribbon winding shaft 208 are rotatable around axial centers.

The printer main body 400 includes electrical system components providing drive control to the units included in the printer 100. The electrical system components include a control board (not depicted), a power source board (not depicted), an interface board 520, a relay board 530, a ribbon board 540, and various cables.

The control board is disposed in a standing manner and is fixed to a bracket (not depicted) that is fixed to the bottom frame 401 outside the shaft paper guide 501. The control board includes a CPU, memory, etc. providing energization control of the print head 204, drive control of the motor 507 that drives the platen 205, drive control of a motor that drives the ribbon support shaft 207 and the ribbon winding shaft 208, etc.

The power source board is connected to the control board. The power source board is located under the head unit 203. The power source board is connected to the control board via a cable (not depicted) that is connected to a connector (not depicted) included in the power source board. The power source board provides a power source to the control board via the cable connecting between the power source board and the control board.

The interface board 520 is connected to the control board via a connector. The interface board 520 includes an interface connector (not depicted) that is connected to an external device. The interface connector is attached via an opening (not depicted) disposed in the lower housing 101*a* such that the interface connector is exposed externally, from a rear aspect of the lower housing 101*a*.

The relay board 530 is disposed on a left side portion between the head unit 203 and the paper holding unit 202. The relay board 530 is fixed onto a bracket 407 that is fixed to the bottom frame 401. The relay board 530 is connected to the control board via a cable not depicted.

The ribbon board 540 is attached to the ribbon frame 406*a*. The ribbon board 540 is connected to the motor 405 that drives the ribbon support shaft 207 and the ribbon winding shaft 208 as well as a ribbon rotation detection sensor and a ribbon tension sensor (both not depicted). The ribbon board 540 is connected via a cable 506 to a connector 531 of the relay board 530.

The cable 506 is fixed to a cable supporting member 508 disposed on the ribbon frame 406*a* between the relay board 530 and the ribbon board 540. The cable supporting member 508 is disposed projecting from the lower end of the ribbon frame 406*a* to a position on a rotation center axis of the head unit 203 relative to the printer main body 400 or in the vicinity of the rotation center axis.

By fixing the cable 506 to a position on the rotation center axis of the head unit 203 relative to the printer main body 400 or in the vicinity of the rotation center axis, the cable 506 can be restrained from being damaged because of pulling and rubbing due to the rotation of the head unit 203. The cable supporting member 508 may be used for fixing not only the cable 506 but also other cables supplying electricity and outputting control signals to the print head 204 included in the head unit 203 and various sensors such as a sensor detecting a position of the paper 201.

The ribbon board 540 receives the power source supplied from the control board and the control signals output from the control board via the relay board 530 and is thereby driven by the control board. The ribbon board 540 may be provided with connectors connecting cables for controlling a paper cutter, a peeler (a peeling mechanism), etc. (all not depicted).

The head unit 203 is rotatably coupled to the printer main body 400 via a shaft (not depicted) having an axial direction that is a direction parallel to the conveyance direction of the paper 201 conveyed through the conveyance path (the longitudinal direction of the paper 201). The printer main body 400 is equipped with a lock mechanism (not depicted) locking the head unit 203 such that the head unit 203 is fixed to the printer main body 400. The printer main body 400 is equipped with a lock release lever 404 that releases the locking of the lock mechanism. The lock release lever 404 is rotatably coupled to the printer main body 400.

The lock release lever 404 is biased from the rear toward the front of the printer 100 and is positioned at an anterior aspect to lock the head unit 203 in a fixed state to the printer main body 400. The locking of the lock mechanism is released by rotating the lock release lever 404 in a direction from the front toward the back of the printer 100. Manipulation of the printer main body 400, the head unit 203, and the lock release lever 404 are enabled in the printer 100 when the upper housing 101*b* is rotated relative to the lower housing 101*a* to open the housing space exteriorly.

The pair of the ribbon frames 406 in the head unit 203 supports the ends of the ribbon support shaft 207 and the ribbon winding shaft 208 such that the ribbon support shaft 207 and the ribbon winding shaft 208 are rotatable. The pair of the ribbon frames 406 is integrally formed by sheet-metal working of a metal plate-shaped member having a predetermined thickness. The motor 405 that rotates the ribbon winding shaft 208 is disposed on the ribbon frame 406*a* of the pair of the ribbon frames 406. FIGS. 4 and 5 depict a state with the case 209 removed.

Figure 6:
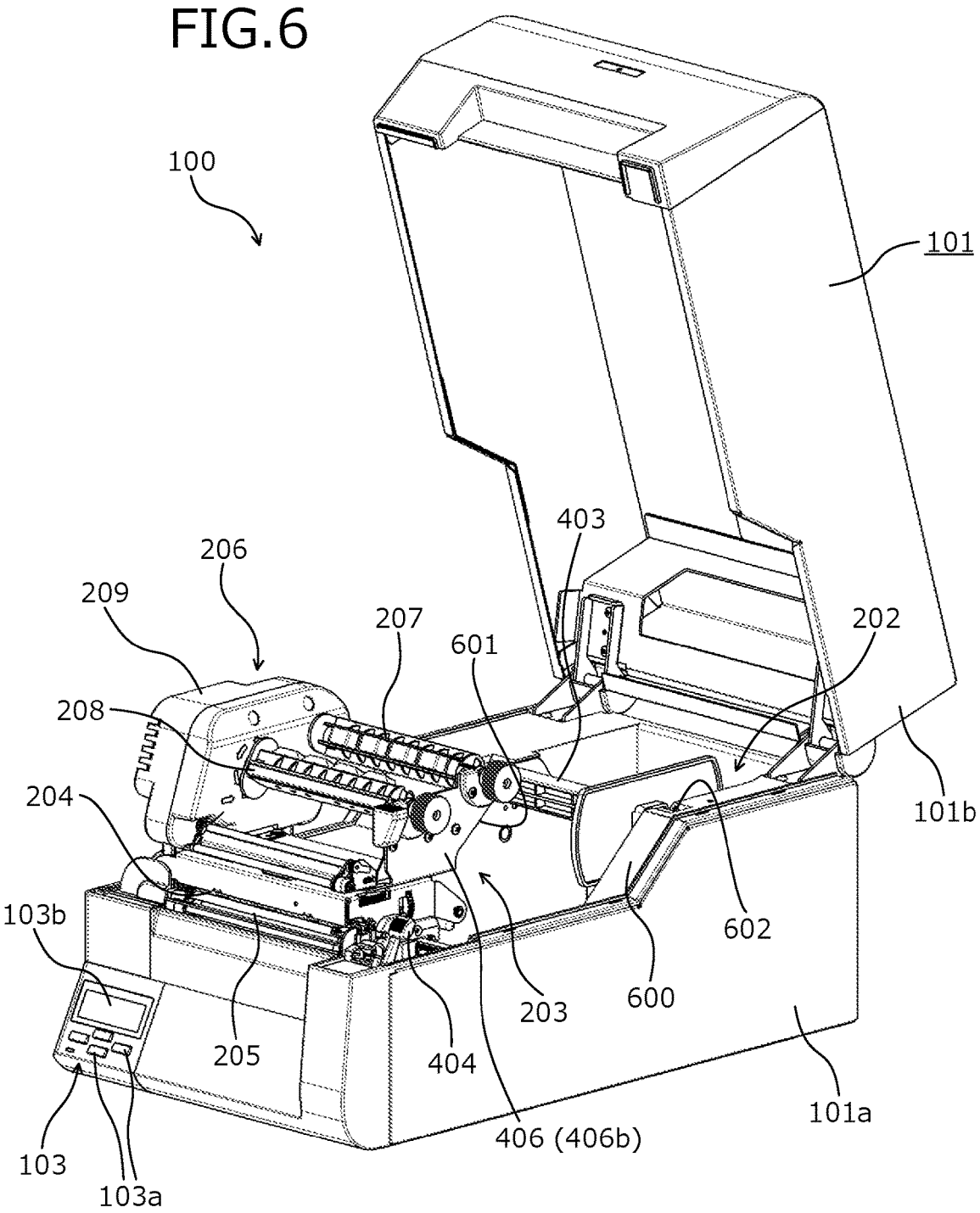
FIG. 6 is an explanatory view (part 1) of the printer with the housing opened.
Figure 7:
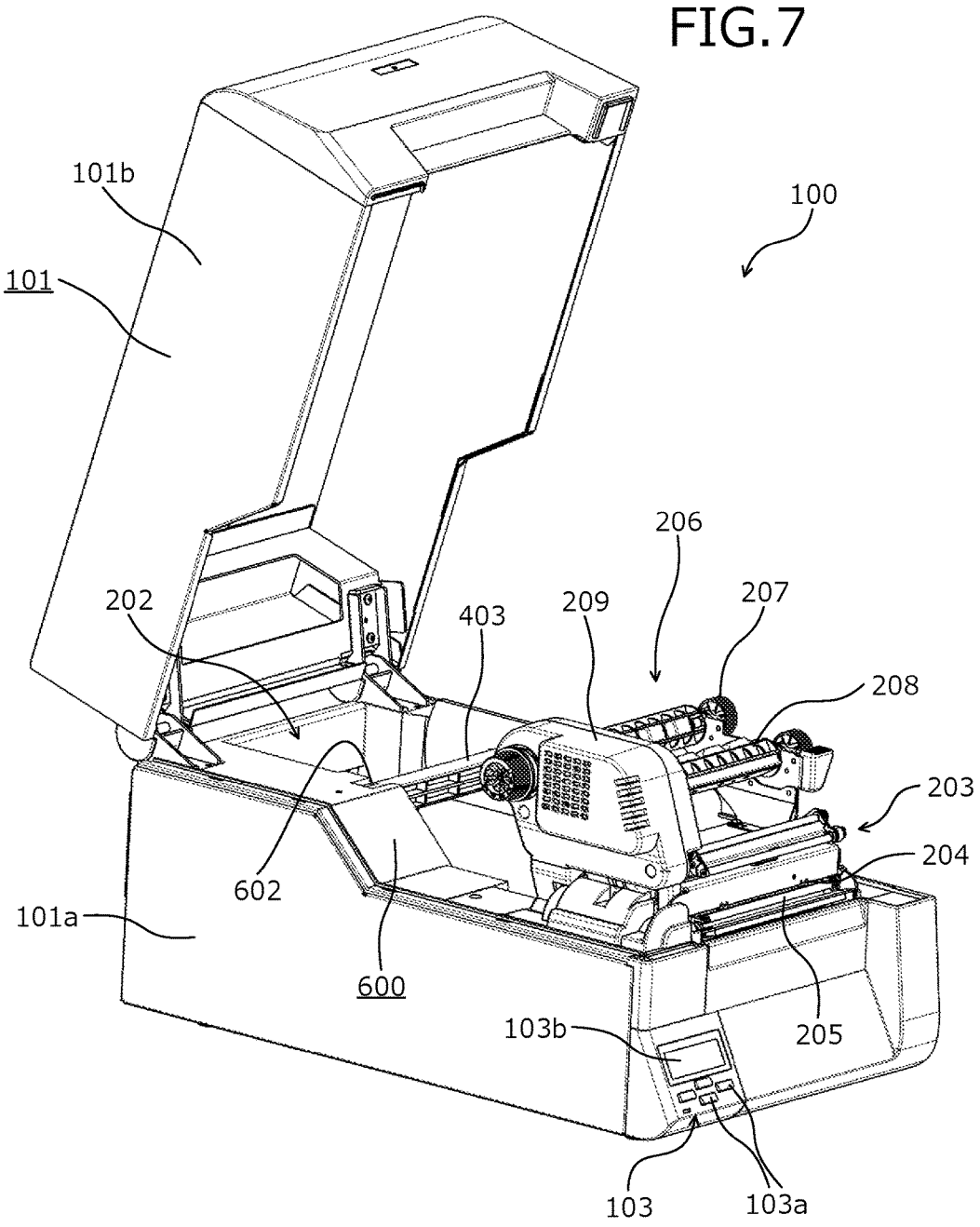
FIG. 7 is an explanatory view (part 2) of the printer with the housing opened.
Figure 8:
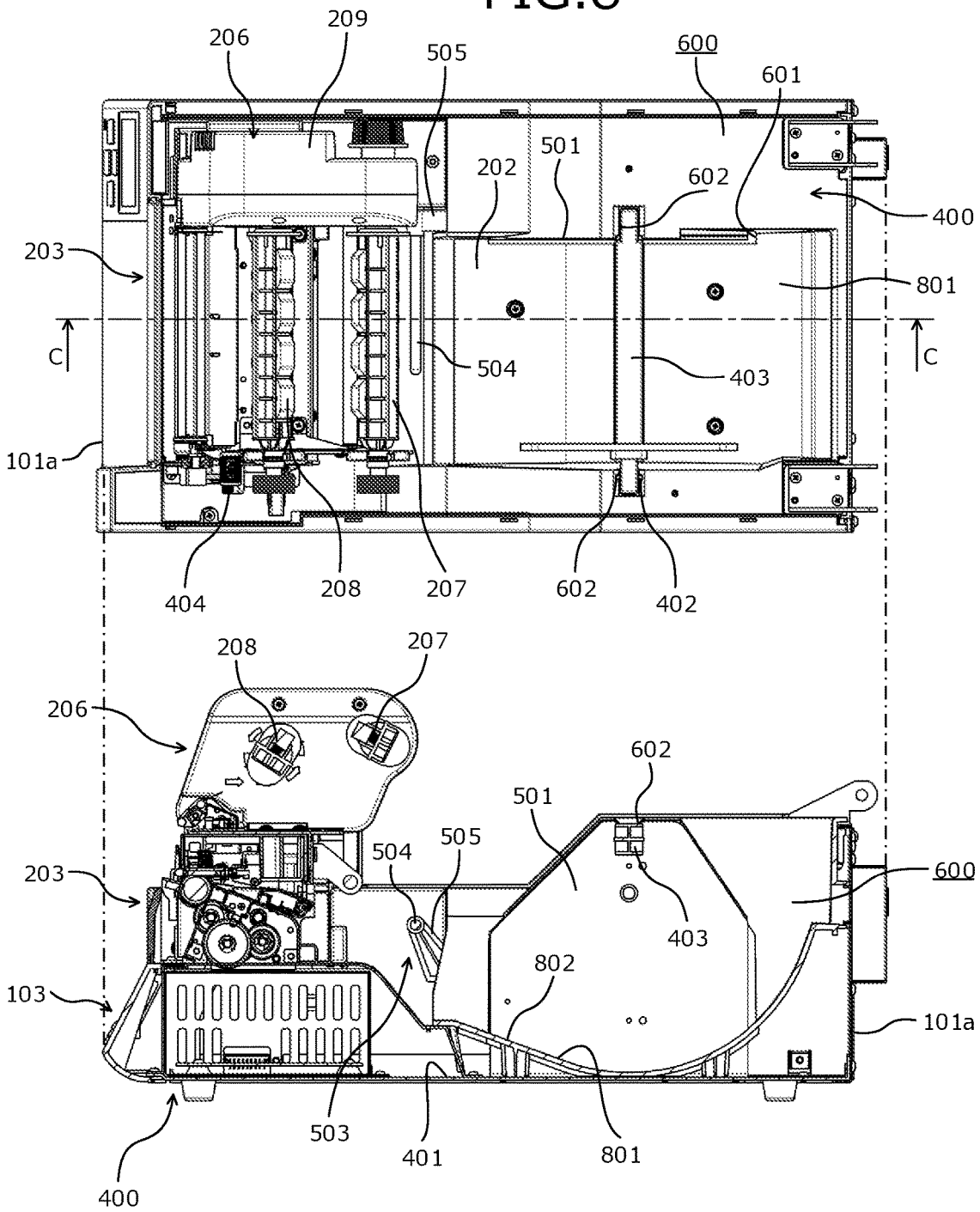
FIG. 8 is a diagram (part 1) depicting an upper aspect and a cross section of the printer of the embodiment according to the present invention.
Figure 9:
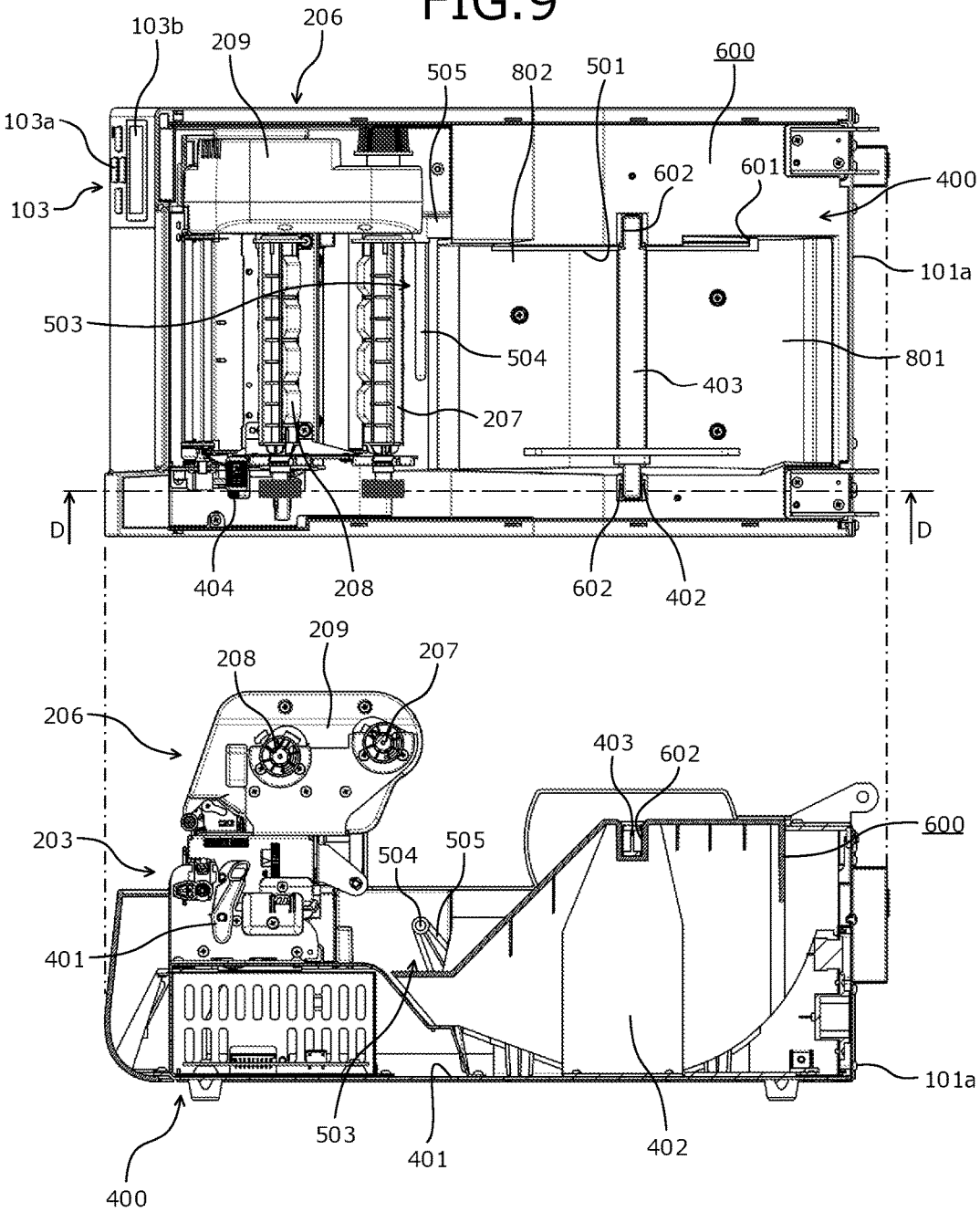
FIG. 9 is a diagram (part 2) depicting an upper aspect and a cross section of the printer of the embodiment according to the present invention.
Figure 10:
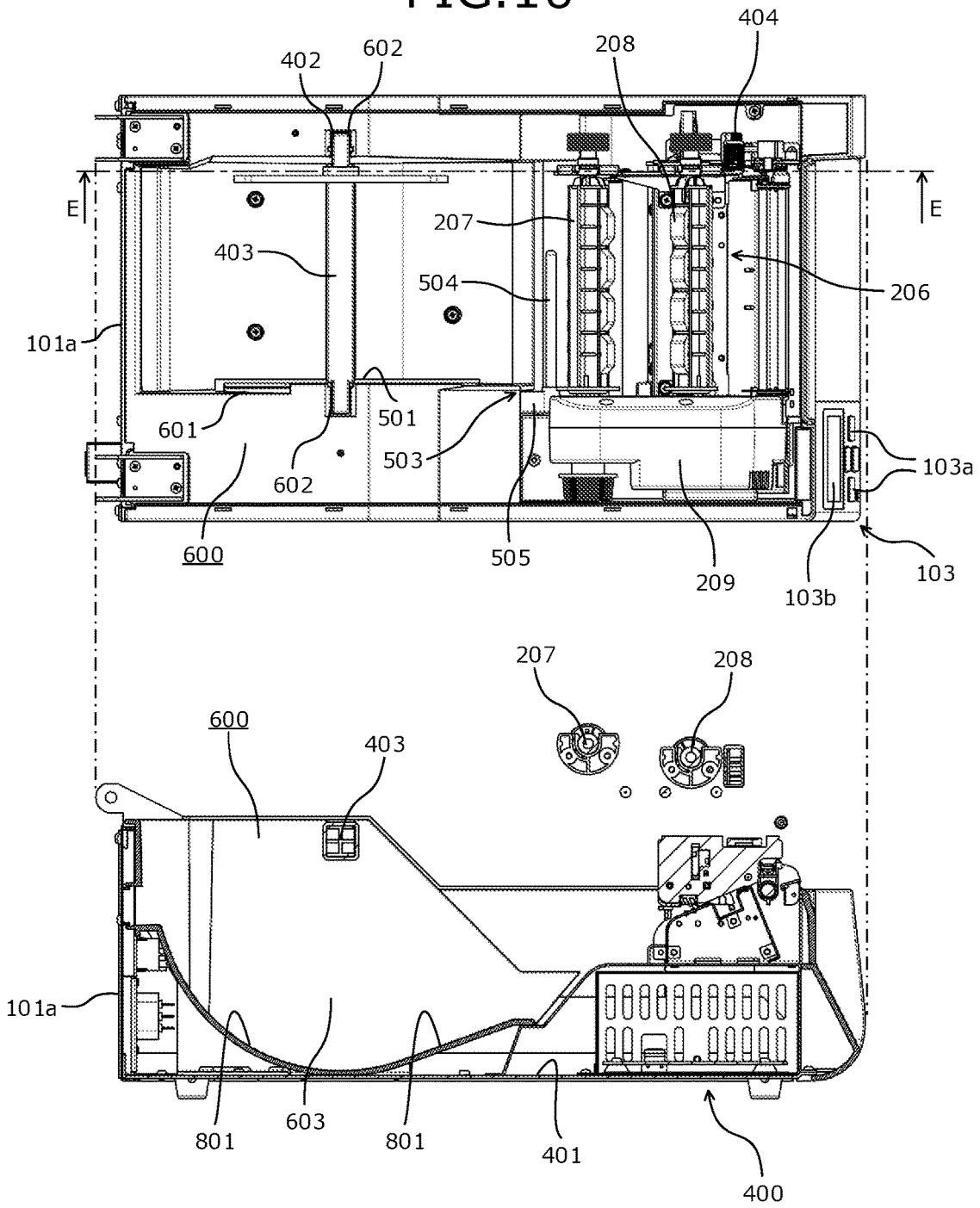
FIG. 10 is a diagram (part 3) depicting an upper aspect and a cross section of the printer of the embodiment according to the present invention.
Figure 11:
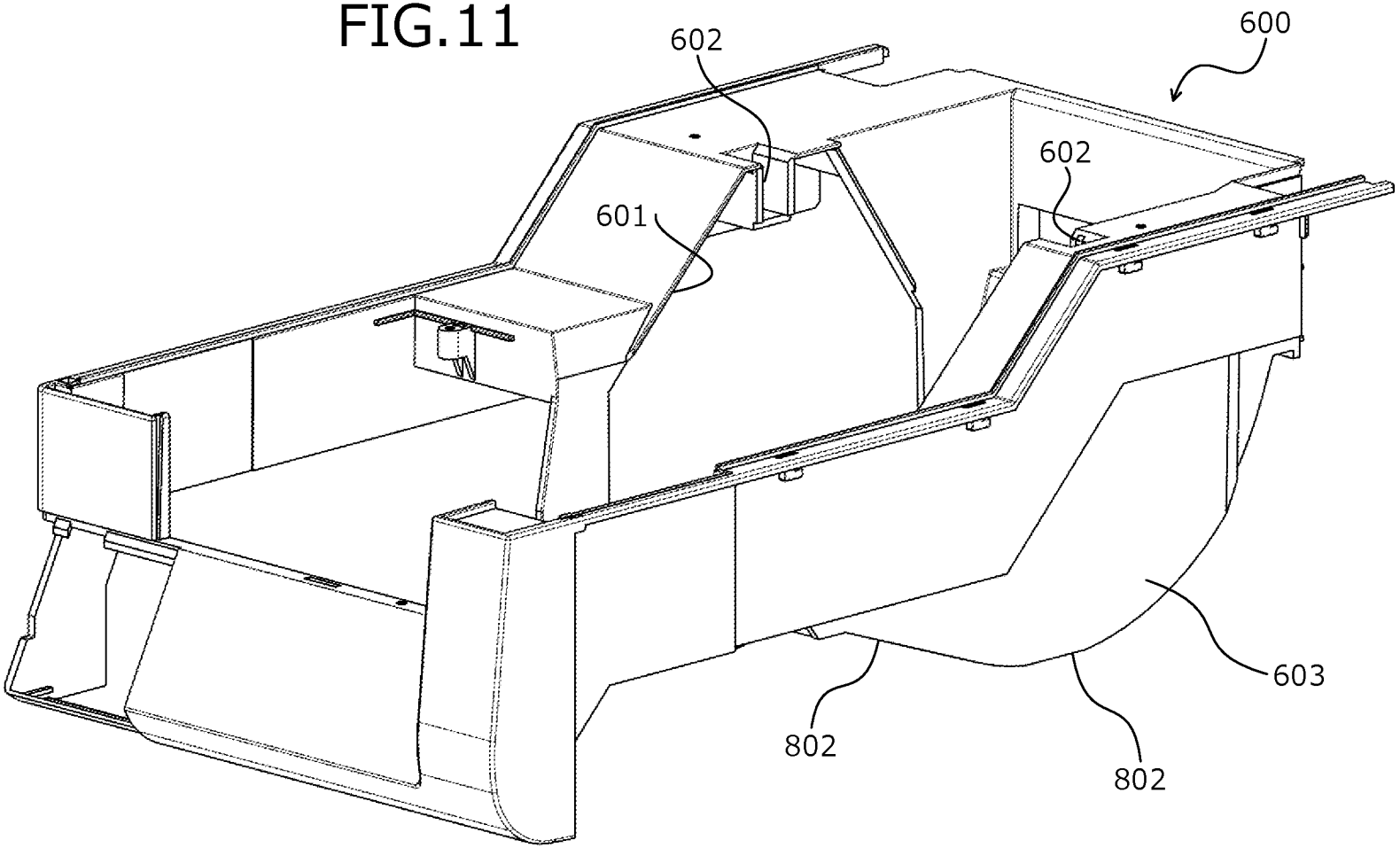
FIG. 11 is a perspective view (part 1) of an exterior cover.
Figure 12:
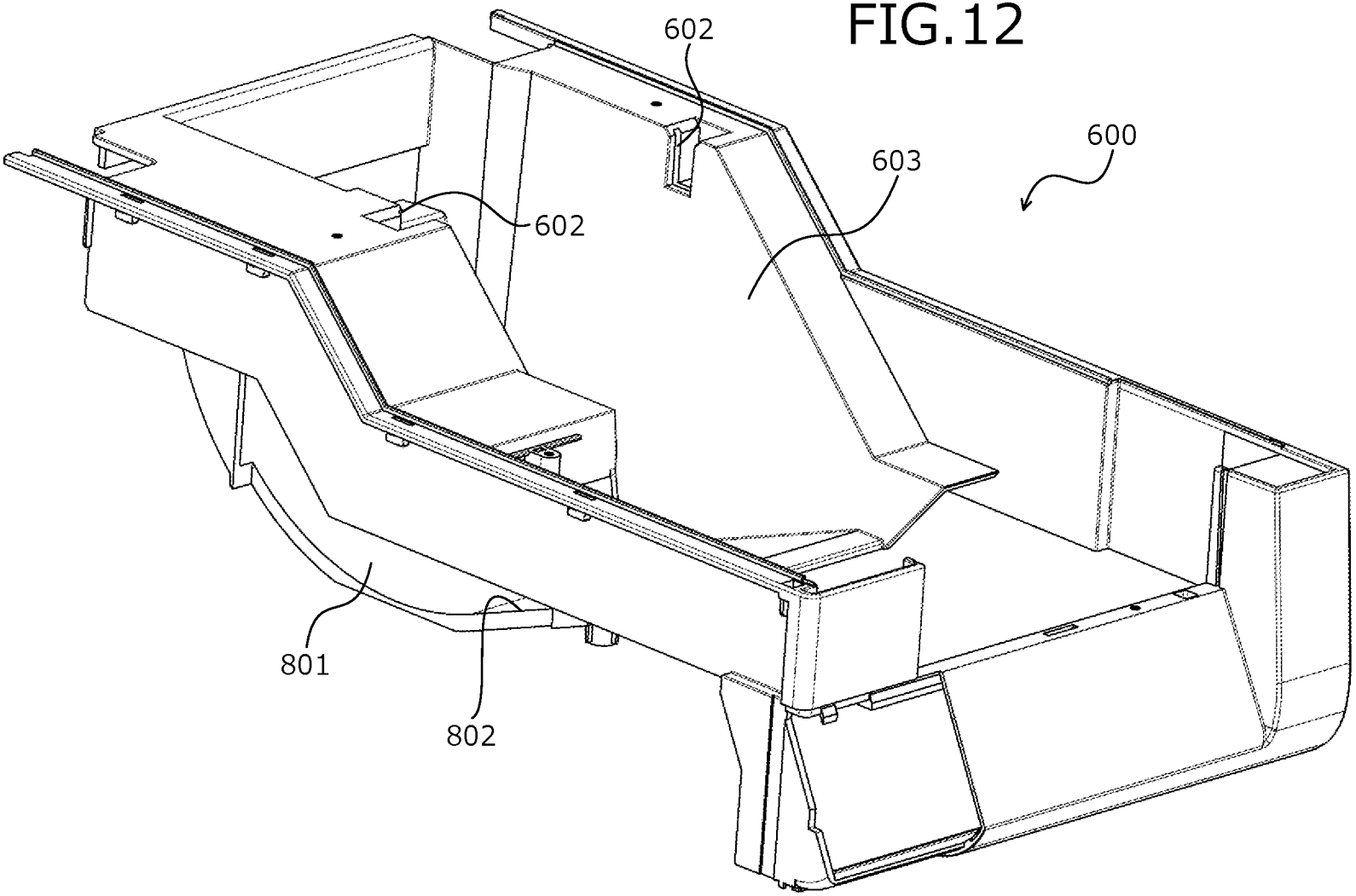
FIG. 12 is a perspective view (part 2) of the exterior cover.

FIGS. 6 and 7 are explanatory views of the printer 100 with the housing 101 opened. FIGS. 8, 9, and 10 are diagrams of an upper aspect and a cross section of the printer 100 of the embodiment according to the present invention. FIGS. 11 and 12 are perspective views of an exterior cover.

FIG. 6 depicts a state where in the state of the printer 100 depicted in FIG. 2, the paper 201 held by the paper holding unit 202 has been removed. FIG. 7 depicts a state where in the state of the printer 100 depicted in FIG. 3, the paper 201 held by the paper holding unit 202 has been removed. FIGS. 8, 9, and 10 depict an upper aspect and a cross section of the printer 100 in a state where the upper housing 101*b* has been removed from the lower housing 101*a* to expose a portion of the printer main body 400.

The upper side of FIG. 8 depicts the printer 100 viewed from above, in a state where the upper housing 101*b* has been removed from the lower housing 101*a* to expose a portion of the printer main body 400. The lower side of FIG. 8 depicts a cross section taken along line C-C in the upper aspect view on the upper side of FIG. 8.

The upper side of FIG. 9 depicts the printer 100 viewed from above, in a state where the upper housing 101*b* has been removed from the lower housing 101*a* to expose a portion of the printer main body 400. The lower side of FIG.

9 depicts a cross section taken along line D-D in the upper aspect view on the upper side of FIG. 9.

The upper side of FIG. 10 depicts the printer 100 viewed from above, in a state where the upper housing 101*b* has been removed from the lower housing 101*a* to expose a portion of the printer main body 400. The lower side of FIG. 10 depicts a cross section taken along line E-E in the upper aspect view on the upper side of FIG. 9.

In FIGS. 6, 7, 8, 9, 10, 11, and 12, an exterior cover 600 that covers the pair of the shaft paper guides 402, 501 is disposed in the housing 101 (the lower housing 101*a*). The exterior cover 600 is formed using an insulating material. The exterior cover 600 is attached to the housing 101 (the lower housing 101*a*) to cover the electrical system components related to the driving of the units included in the printer 100 inside the housing 101 (the lower housing 101*a*).

The exterior cover 600 has an opening 601 exposing a surface of the shaft paper guide 501 that is on the side equipped with some of the electrical system components, the surface facing the paper 201 held by the paper holding unit 202. An opening 602 opens the cutout portion 501*a* disposed in the shaft paper guide 501 to the exterior. The paper 201 in a wound state and held by the paper holding unit 202 has a side surface allowed to abut the surface of the shaft paper guide exposed from the exterior cover 600 and is thereby positioned in the printer 100.

As described above, the shaft paper guides 402, 501 are formed by sheet-metal working of a metal plate-shaped member having a predetermined thickness and therefore, are formed with high processing accuracy. Similarly, the bottom frame 401 is formed by sheet-metal working of a metal plate-shaped member having a predetermined thickness and therefore, is formed with high processing accuracy. Since the paper 201 is positioned by allowing the side surface of the paper 201 held by the paper holding unit 202 to abut the shaft paper guide 501 fixed to the bottom frame 401, the paper 201 can be positioned precisely in the printer 100.

The exterior cover 600 further has the opening 602 opening to the exterior, the cutout portion 402*a* disposed in the shaft paper guide 402 that is on the side without the electrical system components. When attached to the housing 101 (the lower housing 101*a*), the exterior cover 600 covers the pair of the shaft paper guides 402, 501 with the cutout portions 402*a*, 501*a* opened to the exterior through the opening 602. The exterior cover 600 includes a bottom portion 801 and a guiding portion 802. The bottom portion 801 forms an arc along the outer diameter of the paper 201 held by the paper holding unit 202.

The guiding portion 802 is continuous to the bottom portion 801 and is sloped relative to the bottom frame 401 such that a position closer to the paper holding unit 202 is lower from the head unit 203 toward the paper holding unit 202. Since the guiding portion 802 is disposed, even when the paper 201 housed in the housing 101 is pulled toward the head unit 203 during a recording operation, the paper 201 can be restrained from coming closer to the front side while remaining in the roll state.

The exterior cover 600 includes a side wall portion 603 covering, among the pair of the shaft paper guides 402, 501, the shaft paper guide 402 on the side without the electrical system components. The opening 602 is formed by partially cutting out the side wall portion 603. As depicted in FIGS. 11 and 12, the exterior cover 600 is achieved by a single member formed by a method such as injection molding of plastic material.

As described above, the printer 100 of the embodiment according to the present invention includes a housing 101 forming a substantially box shape; and the shaft paper guides 402, 501 acting as a pair of frames disposed in the housing 101 and arranged to oppose each other across the conveyance path of the recording medium; the cutout portions 402*a*, 501*a* respectively disposed at the upper ends of the pair of the shaft paper guides 402, 501; and the shaft 403 that while inserted inside the winding core on which the long paper 201 is wound into a roll shape, both ends of the shaft 403 are supported by the cutout portions 402*a*, 501*a*, whereby the paper is held while allowing the paper to be pulled out from the housing 101. The printer 100 of the present embodiment is characterized by including the exterior cover 600 that is disposed in the housing 101, is formed using an insulating material, has the openings 601, 602 that open the cutout portions 402*a*, 501*a* exteriorly, and covers the pair of the shaft paper guides 402, 501 with the cutout portions 402*a*, 501*a* opened exteriorly through the openings 601, 602.

According to the printer 100 of the embodiment of the present invention, the shaft paper guides 402, 501 acting as a pair of frames can be formed by using a metal material such as a sheet metal member to ensure the strength of the pair of the shaft paper guides 402, 501 and, even when the pair of the shaft paper guides 402, 501 is formed by using a metal material, the pair of the shaft paper guides 402, 501 can be assuredly insulated from the exterior by merely covering the pair of the shaft paper guides 402, 501 with the exterior cover 600 without applying a coating treatment to the pair of the shaft paper guides 402, 501. This enables a reduction in manufacturing costs related to the printer 100 with a strength ensured for holding large diameter roll paper.

According to the printer 100 of the embodiment of the present invention, the exterior cover 600 is disposed with the openings 601, 602, whereby a configuration enabling both ends of the shaft 403 to be supported by the pair of the shaft paper guides 402, 501 can be easily and assuredly achieved while the pair of the shaft paper guides 402, 501 is insulated from the exterior by merely covering the pair of the shaft paper guides 402, 501 with the exterior cover 600. Thus, manufacturing man-hours of the printer 100 can be suppressed while the burden placed on the worker for manufacturing the printer 100 is reduced, whereby a reduction in costs related to manufacturing of the printer 100 can be achieved.

The printer 100 of the embodiment of the present invention includes the electrical system components (such as the control board and power source board not depicted, the interface board 520, the relay board 530, the ribbon board 540, and various cables) disposed in the housing 101 and related to the driving of the units included in the printer 100 and the printer 100 is characterized in that the exterior cover 600 also covers the electrical system components.

According to the printer of the embodiment of the present invention, by merely mounting the one exterior cover 600 inside the housing 101, the pair of the shaft paper guides 402, 501 and the electrical system components can be covered and the pair of the shaft paper guides 402, 501 and the electrical system components can be insulated from the exterior. Thus, manufacturing man-hours of the printer 100 can be suppressed while the burden placed on the worker for manufacturing the printer 100 is reduced, whereby a reduction in costs related to manufacturing of the printer 100 can be achieved.

INDUSTRIAL APPLICABILITY

As described above, the printer according to the present invention is applicable for a printer that uses long paper wound into a roll shape as a recording object and is particularly suitable for a printer that uses large-sized heavy roll paper as a recording object.

EXPLANATIONS OF LETTERS OR NUMERALS

100 printer
202 paper holding unit
402, 501 shaft paper guide
402*a*, 501*a* cutout portion
600 exterior cover
601, 602 opening
603 side wall portion
801 bottom portion
802 guiding portion

The invention claimed is:

1. A printer comprising:

a housing forming a substantially box shape;

a pair of frames disposed in the housing and arranged such that the frames oppose each other across a conveyance path of a recording medium;

a cutout portion disposed at an upper end of each of the frames;

a shaft that while inserted inside a winding core on which long paper is wound into a roll shape, both ends of the shaft are supported by the cutout portions and the shaft holds the paper while allowing the paper to be pulled out from the housing; and an exterior cover that is disposed in the housing, is formed using an insulating material, has openings that open the cutout portions exteriorly, and covers the pair of the frames with the cutout portions opened exteriorly through the openings.

2. The printer according to claim 1, further comprising electrical system components disposed in the housing and related to driving of units included in the printer, wherein the exterior cover also covers the electrical system components.

* * * * *